United States Patent [19]

Riviere

[11] 4,425,852

[45] Jan. 17, 1984

[54] PALLET CONSTRUCTION

[75] Inventor: Donald L. Riviere, Neenah, Wis.

[73] Assignee: Menasha Corporation, Neenah, Wis.

[21] Appl. No.: 317,792

[22] Filed: Nov. 4, 1981

[51] Int. Cl.[3] ..... B65D 19/26; B65D 19/40

[52] U.S. Cl. ..... 108/56.3; 108/53.3

[58] Field of Search ..... 108/56.3, 56.1, 53.3; 206/599, 600

[56] References Cited

U.S. PATENT DOCUMENTS

| | | | |
|---|---|---|---|
| 3,598,065 | 8/1971 | Young | 108/56.3 X |
| 3,610,172 | 10/1971 | Wharton | 108/56.3 |
| 3,664,272 | 5/1972 | Sanders | 108/56.3 X |
| 4,267,781 | 5/1981 | Powers | 108/56.3 X |

FOREIGN PATENT DOCUMENTS

| | | | |
|---|---|---|---|
| 2411136 | 8/1979 | France | 108/56.3 |

*Primary Examiner*—William E. Lyddane

*Attorney, Agent, or Firm*—Andrus, Sceales, Starke & Sawall

[57] ABSTRACT

An expendable pallet comprises a deck or platform having feet anchored to the platform to space the platform from the floor. Each of the feet supporting the deck or platform comprises an engageable cup-like member and an annular locking ring member. The cup-like member is insertable within a suitable hole in the platform to engage a peripheral flange on the upper extremity thereof with the upper platform surface. A circumferential shoulder is provided exteriorly on the cup-like member in spaced relation beneath the flange. The locking ring member comprises a depending skirt that terminates at its lower extremity with an annular shoulder engaging surface and has an outwardly and peripherally extending flange at the upper extremity thereof. The locking ring member is adapted for disposal beneath the platform and exteriorly on the cup-like member to engage upon the shoulder of the cup-like member and sandwich the platform between the opposed flanges of the members.

9 Claims, 10 Drawing Figures

Fig. 1
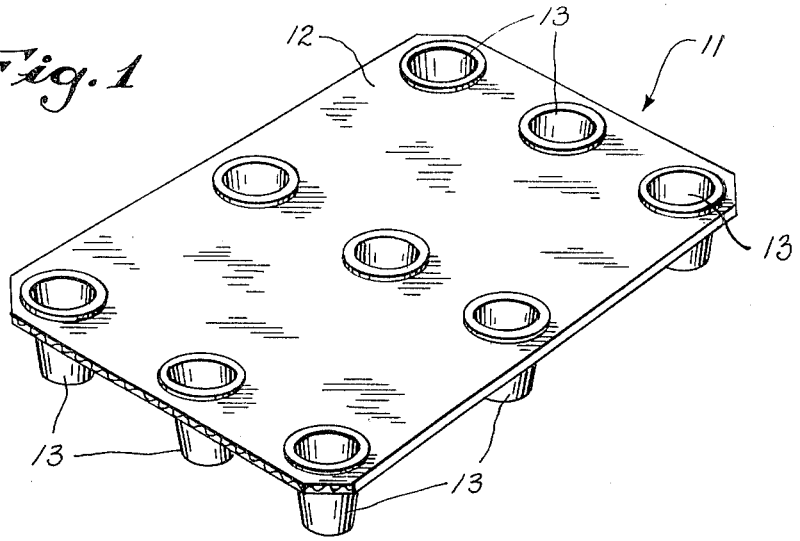
Fig. 3
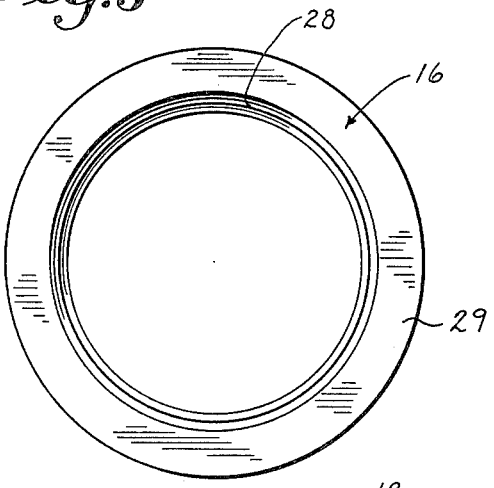
Fig. 4
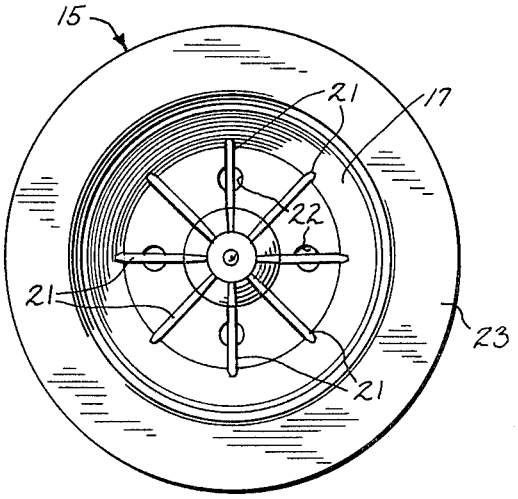
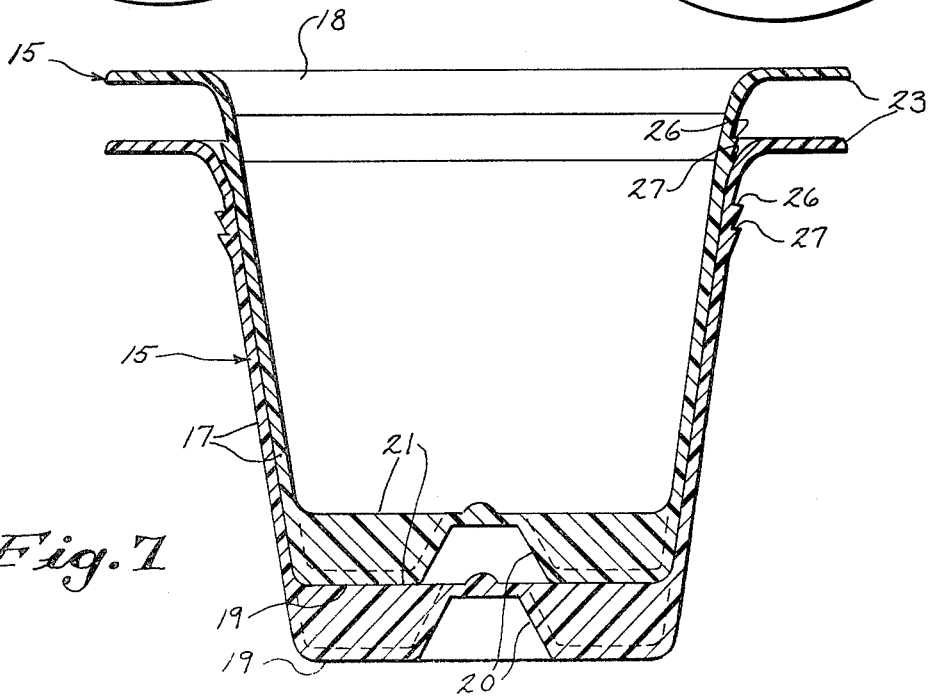
Fig. 7

PALLET CONSTRUCTION

BACKGROUND OF THE INVENTION

This invention relates to the construction of a pallet of the general type which have come to be known an expendable pallets.

Expendable pallets generally comprise a deck or platform having some degree of rigidity supported in spaced relation from the floor by a plurality of spaced feet. The platform is most commonly a single sheet or superposed sheets of corrugated paperboard, but solid fiberboard, plywood or other sheet material may also be used. The individual feet are generally made of molded plastic such as polystyrene, polyethylene or polypropylene, providing a relatively rigid structure having some elasticity.

The assignee of this invention is the owner of U.S. Pat. No. 3,610,172 for a Pallet Construction of the general type here involved. In the patented structure, the individual feet supporting the deck or platform comprise a frustoconically-shaped cup-like member and a locking ring member. The cup-like member of the patented structure has an upwardly opening mouth with a radially outward extending circumferential flange at the upper periphery thereof. Interiorly and spaced beneath the flange, the cup-like member is provided with a circumferentially extending, inwardly projecting lip or shoulder. The locking ring member of the patented structure is engageable within the cup-like member and is provided exteriorly and generally adjacent to its lower extremity with a circumferentially extending, outwardly projecting locking rib to generally interlock beneath the lip or shoulder of the cup-like member to secure the members together. At its upper periphery the locking ring is provided with a radially outward extending circumferential flange which, in the assembly of the leg, generally overlies the flange on the cup-like member. In the assemblage of the feet to the platform, each foot is installed at a suitable die-cut opening in the platform with the locking ring member disposed above and making engagement with a cup-like member disposed beneath the platform. In the assembly, the platform is secured between the superposed flanges of the members to secure the foot to the platform and to space the platform from the floor.

In the structure of U.S. Pat. No. 3,610,172, the cup-like members occasionally became separated from the locking ring members in the pallet assembly. While the reason for any such separation is difficult to pinpoint, it is possible that only a "false" jam lock between the members was attained rather than an intended interlock. Since the area of engagement between the members is totally obscured in the patented structure, visual confirmation relative to a proper interlock between the members is at best difficult. Also, and particularly if a pallet is heavily loaded, plastic creep conceivably could give rise to a separation between the members in the patented structure. The load on the pallet acts through the locking ring member to effect a radial expansion of the molded plastic cup-like member while the ring member itself may be caused to contract radially. Should the expansion of the cup-like member and/or the contraction of the locking ring member exceed the radial bounds of the locking rib on the locking ring member, the cuplike member will be free to fall away when the load on the cuplike member is suddenly relieved, as when the loaded pallet is lifted by fork-lift or other means (because the molded plastic is slow to rebound from the radial deformation). Further, if the load on the pallet acts to deflect the platform downward locally with respect to a foot, such deflection will in turn deflect the flange on the corresponding cup-like member downwardly and tend to pry the cup-like member and locking ring member apart. It is generally an object of this invention to avoid the aforementioned problems and provide a pallet construction wherein the feet elements are far less likely to separate and render the pallet defective or unusable.

SUMMARY OF THE INVENTION

The invention is directed to a pallet having a load bearing surface or platform and feet anchored to the platform to space the platform from the floor. Each of the pallet feet comprises a cup-like member which is oriented with the mouth opening upwardly. The cup-like member is provided with an integral, outwardly and peripherally extending flange at its upper extremity and is insertable within a suitable hole in the platform to place the underside of the flange into engagement with the upper platform surface adjacent to the hole. The cup-like member is further provided with an outwardly projecting, upwardly facing shoulder exteriorly thereof and spaced beneath the flange. Each of the pallet feet also includes a locking ring member which comprises an outwardly and peripherally extending flange disposed upwardly and a shoulder engaging surface disposed downwardly. The locking ring member is adapted for disposal on the cup-like member beneath the platform to engage upon the shoulder of the cup-like member and sandwich the platform between the opposed flanges of the members.

DESCRIPTION OF THE DRAWING FIGURES

The drawings furnished herewith illustrate the best mode presently contemplated for the invention and are described hereinafter.

In the drawings:

FIG. 1 is a perspective view of an assembled pallet wherein a plurality of spaced feet are secured to and support a deck or platform of sheet material generally in accordance with the invention;

FIG. 3 is an upper plan view of the locking ring member of a pallet foot;

FIG. 4 is an upper plan view of the cup-like member of a pallet foot;

FIG. 7 is an elevational view in section showing the nesting and stacking character of the cup-like members for the pallet feet;

DESCRIPTION OF THE ILLUSTRATED EMBODIMENTS

Figure 2:
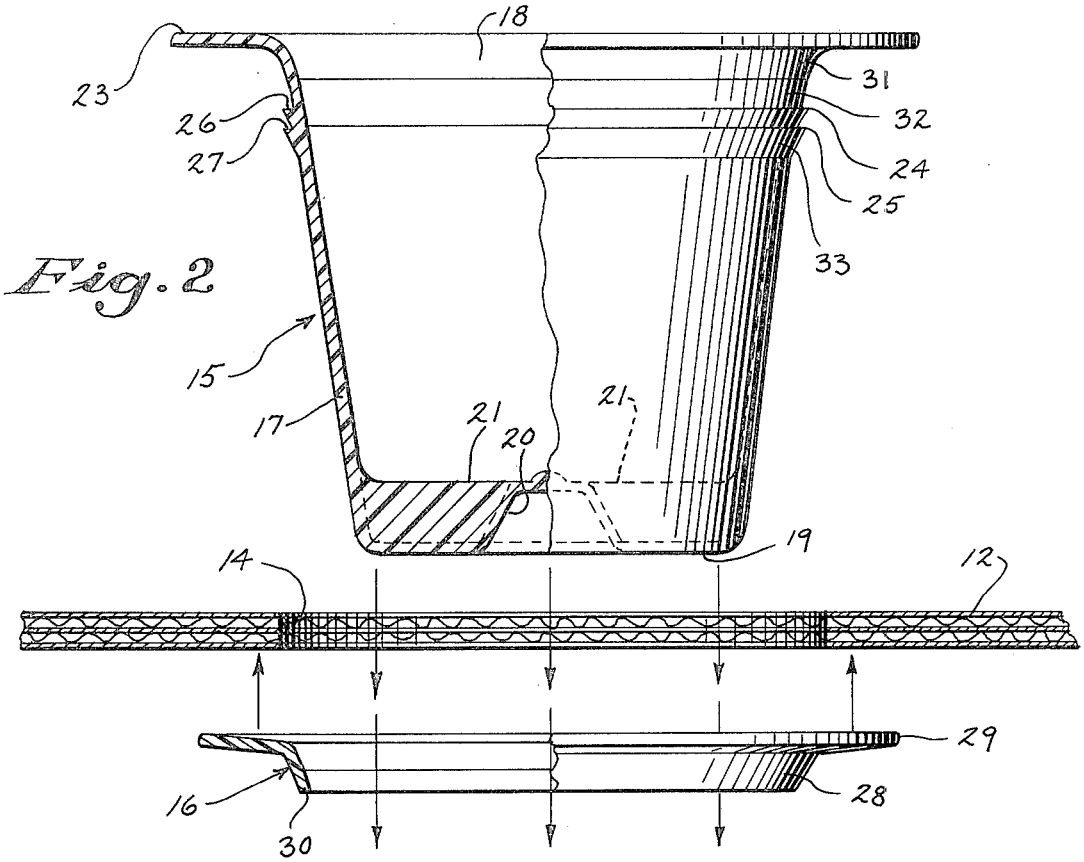
FIG. 2 is an exploded view partially in section generally showing with the aid of direction arrows how the foot portions are assembled relative to a diecut hole provided in the deck or platform of the pallet.

Referring to the drawings, the pallet 11 of this invention may be characterized as being expendable or nonreturnable and generally comprises a deck or platform 12 of sheet material which is spaced from the floor by a plurality of spaced feet 13 secured to the platform. While any relatively rigid sheet material may be employed for the platform 12, it is contemplated that a single sheet or superposed sheets of corrugated paperboard will be most commonly used. At least when the platform 12 is a paper product, the platform is provided with spaced die-cut circular holes 14 for installation of the corresponding feet 13 which are formed of a molded plastic such as polystyrene, polyethylene or polypropylene providing a relatively high impact strength and giving the pallet 11 a substantial load capacity.

While the pallet 11 of FIG. 1 is provided with nine (9) feet 13, the actual number of feet required will be determined by specific load and handling requirements and generally will vary from four (4) to twelve (12). The height and placement pattern for the feet 13 are usually determined by the procedure and equipment to be used for handling the loaded pallets 11.

As generally shown in FIG. 2, each foot 13 generally comprises a cup-like member 15 and a locking ring member 16. The members 15 and 16 are engaged from opposite sides of the platform 12 as will be further described hereinafter to secure the foot 13 to the platform.

The cup-like member 15 comprises a generally frustoconically-shaped molded plastic shell having a side wall 17 that tapers downwardly from an upwardly opening mouth 18 to a generally closed, flat bottom 19 of reduced diameter. The bottom 19 is provided with an inwardly projecting indentation 20 generally centrally thereof. Interiorly the bottom 19 of member 15 is reinforced by a plurality of angularly spaced ribs 21 that extend between the indentation 20 and the side wall 17. A plurality of spaced holes 22 are provided in the bottom 19 to preclude any possible accumulation of water or other liquid in the member 15. The holes 22 also preclude formation of a pressure differential across the bottom 19 between the interior and exterior of the cup-like member 15 to possibly impede stacking with nesting and subsequent removal from the stack.

At its upper extremity and surrounding the mouth 18, the cup-like member 15 is provided with an integral, peripheral flange 23 that extends generally horizontally outward of the member. Spaced beneath the peripheral flange 23 the side wall 17 is provided exteriorly with a pair of axially spaced, outwardly projecting and circumferentially extending ridges 24 and 25 on like diameters. The respective ridges 24 and 25 form corresponding upwardly facing, axially aligned locking shoulders 26 and 27 that extend circumferentially of the member 15 for selective engagement by the annular member 16 as further described hereinafter.

Figure 5:
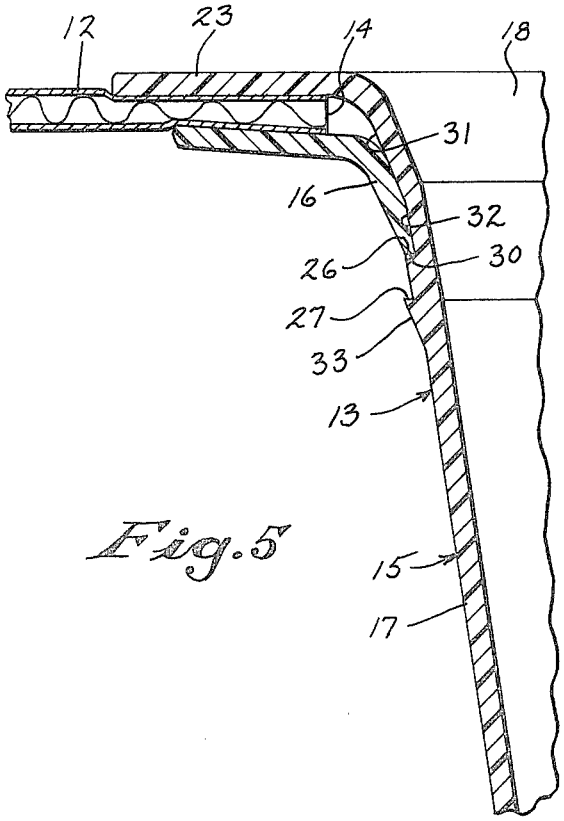
FIG. 5 is an enlarged fragmental section showing the foot portions assembled to a deck or platform comprising a single sheet of material.
Figure 6:
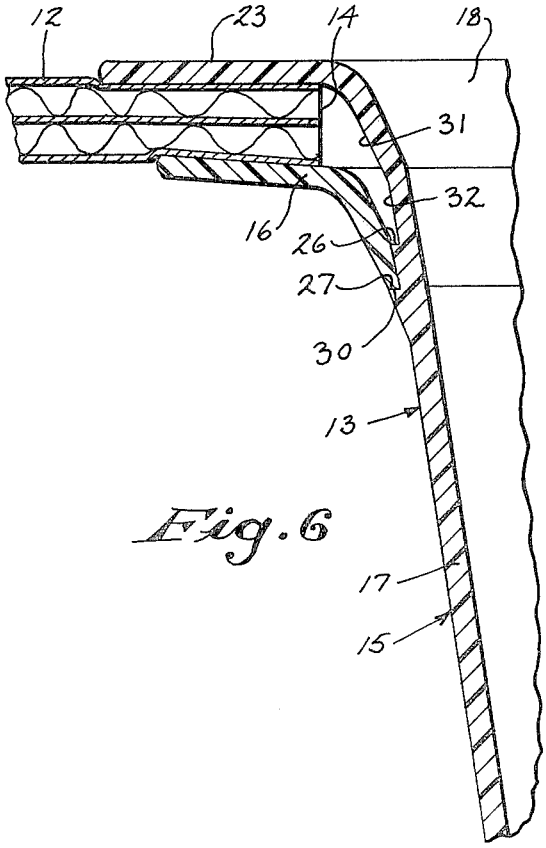
FIG. 6 is a view generally similar to that of FIG. 5 but showing the foot portions assembled to a deck or platform comprising superposed sheets of material.

The annular, molded plastic locking ring member 16 comprises generally a downwardly and inwardly tapered skirt 28 which depends from an outwardly extending, integral flange 29. The lower extremity of the locking ring skirt 28 forms an annular, generally horizontal surface 30 which in the assembly of members 15 and 16 is selectively seated on the shoulders 26 and 27 of the cuplike member. Interiorly the wall surface of skirt 28 is provided with a compound taper to approximate the tapers of the exterior adjacently disposed wall portions 31 and 32 above the shoulder 26 on the cuplike member 15 when the annular skirt surface 30 is seated on the upper shoulder 26 as generally shown in FIG. 5. The exterior wall surface of locking ring skirt 28 is generally straight and forms an approximate continuation of the outwardly projecting wall portion 33 forming the ridge 25 on the cuplike member 15 when the annular skirt surface 30 is seated on the lower shoulder 27 as generally shown in FIG. 6. The inside diameter of the blocking ring skirt 28 at its lower extremity adjacent to the annular surface 30 is slightly less than the diameter of the ridges 24 and 25 on the cup-like member 15 so that the skirt must expand correspondingly as it moves across the ridges during assembly. After the lower extremity of the locking ring skirt 28 clears the selected ridge during assembly, the skirt snaps back or rebounds to seat the annular surface 30 on the corresponding shoulder 26 or 27.

Reference is made to FIG. 2 which generally illustrates the mode of installation of the feet 13 onto the platform 12. As there shown, the cup-like member 15 and locking ring member 16 are disposed on opposite sides of the platform 12 with the cup-like member above and the locking ring member below. Oriented with the mouth 19 facing upwardly, the cup-like member 15 is inserted in the hole 14 of platform 12 as indicated by the direction arrows and is properly seated when the underside of the flange 23 engages with the upper surface of the platform. Oriented with the flange 29 disposed upwardly, the locking ring member 16 is brought over the outside of the downwardly projecting cup-like member 15 beneath the platform 12, and is generally snapped into selected position on the shoulder 26 or 27 placing the upper surface of flange 29 into engagement with the underside of the platform to generally sandwich the platform between the opposing flanges of the members. Since the flange 29 of the annular member 16 extends angularly upward a few degrees from the horizontal, the maximum gripping pressure is exerted on the platform member 12 at the outer periphery of flange 29. For a corrugated paperboard platform 12, the pressure exerted by flange 29 is intended to only slightly pinch and thus only slightly deform the paperboard (as opposed to a more compelling pressure as might actually damage the paperboard and thus greatly weaken the foot mounting). An angular upward disposition in the range of 5° from the horizontal provides the flange 29 with the gripping pressure desired and is adapted to accommodate sheet material of somewhat different thicknesses. FIG. 5 generally shows the anchored foot 13 relative to platform 12 comprising a single sheet of corrugated paperboard. FIG. 6 shows the anchored foot 13 relative to a platform 12 made up of a pair of superposed sheets of corrugated paperboard.

Figure 8:
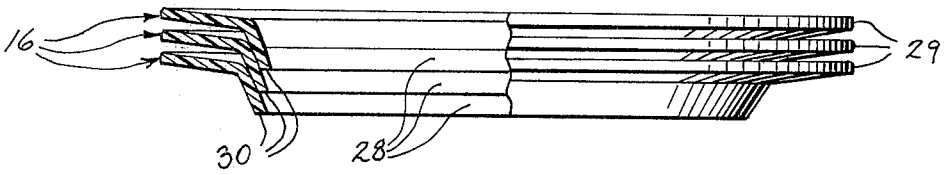
FIG. 8 is an elevational view partly in section and shows the nesting and stacking character of the locking ring members for the pallet feet.
Figure 9:
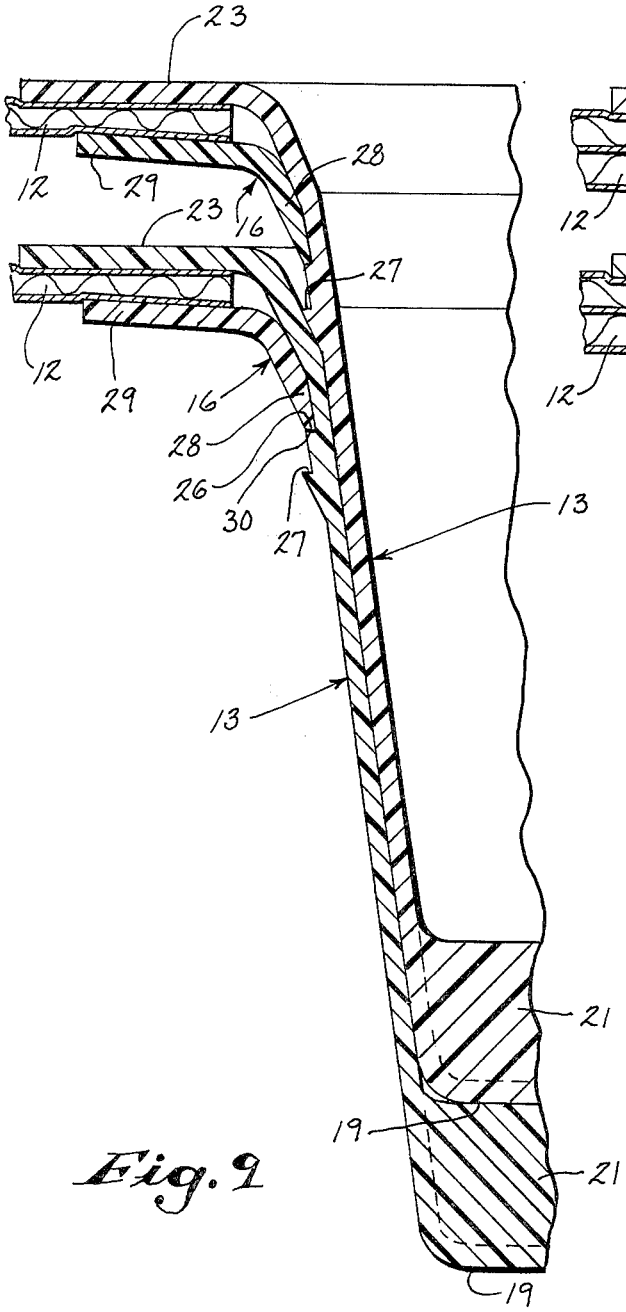
FIG. 9 is an enlarged partial elevational view in section and shows the nesting and stacking character of assembled pallets wherein the platform comprises a single layer of sheet material.
Figure 10:
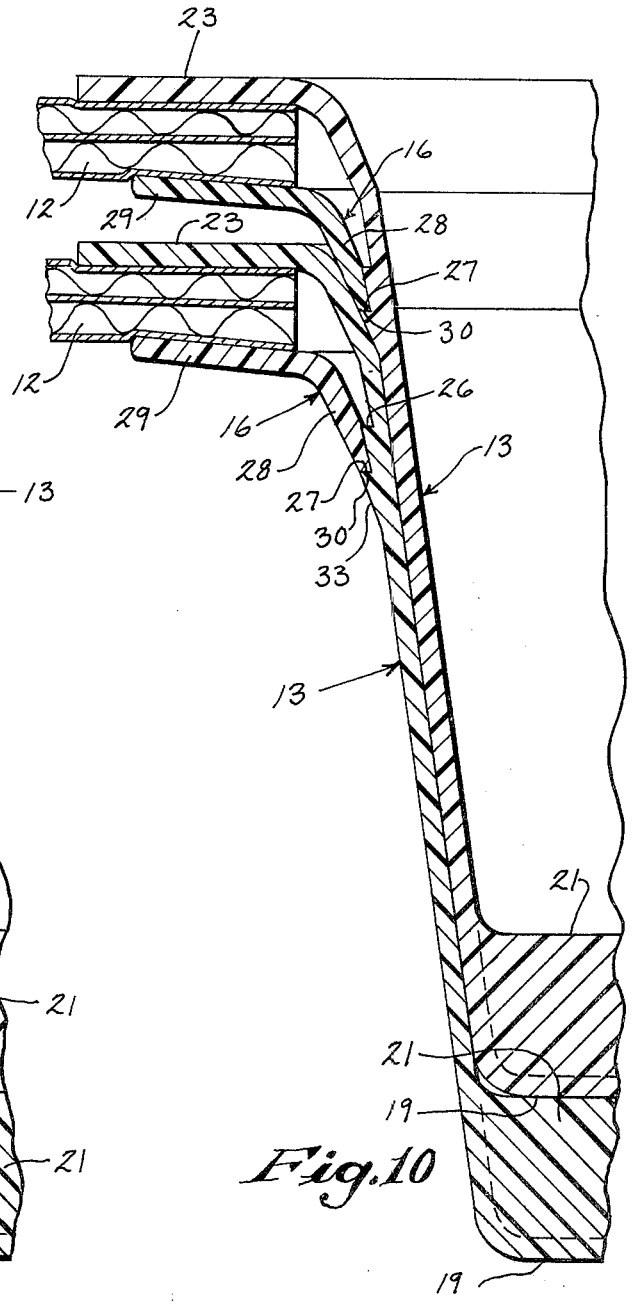
FIG. 10 is an enlarged partial elevational view in section and shows the nesting and stacking character of assembled pallets wherein the platform comprises superposed layers of sheet material.

Pallets 11 may be pre-assembled and be ready for use by the customer, or the separate elements can be supplied for customer assembly. In either case handling and storage is convenient since the separate elements as well as the pre-assembled pallets 11 are nestable and stackable. The stackability of sheet material as provided for the platforms 12 is well known and documented. The nestability and stackability for the cup-like members 15 is illustrated in FIG. 7 wherein it is shown that the lower outwardly projecting ridge 25 is spaced a sufficient distance from the bottom 19 so that the nested cup-like member can be seated on the reinforcement ribbing 21 of the cup-like member therebeneath. The stacking and nesting arrangement for the cup-like members 15 provides for a space between the flanges 23 of adjacent members so that they are readily removable individually from the stack. FIG. 8 illustrates the stackability with nesting for the locking ring members 16 and shows separation between the flanges 29 of adjacent members providing for individual removability with relative ease from the stack. FIGS. 9 and 10 illustrate the stackability of pre-assembled pallets 11 and clearly show that the nestability of the cup-like members 15 is not impeded even when anchored on the platform members 12 and regardless of whether the platform comprises a single sheet or superposed sheets.

Since the shoulders 26 and 27 exteriorly on the cup-like member 15 of this invention are fully exposed to view, "false" jam locks during assembly of the feet 13 onto the platform member 12 should be virtually eliminated. Also, plastic creep ought not to be a factor tending to work a disassembly of the feet 13 from the pallet 11 in service. Any load carried by the pallet 11 and tending to radially expand the cup-like member 15 ought to enhance rather than detract from the shoulder interlock with the locking ring member 16. The shoulder interlock will also tend to be enhanced by any load on the pallet 11 that acts to deflect the platform member 12 downward locally with respect to a foot 13 because the corresponding deflection of the flange 29 on the ring member 16 will simply force the skirt 28 inwardly more tightly against the cup-like member 15. Even, if, however, the locking ring member 16 should somehow become disassembled from its cup-like member 15 when in service on a loaded pallet 11, such pallet will ordinarily not be rendered unserviceably defective. Since the flange 23 of the cup-like member 15 is ordinarily in bearing relation with the load on the pallet 11, the cup-like member will generally remain in place relative to the pallet and thus continue to provide support for the load even after loss of its locking ring member 16. The pallet 11 thus provides substantial advantages over the earlier patented structure of the present assignee.

Various modes of carrying out the invention are contemplated as being within the scope of the following claims particularly pointing out and distinctly claiming the subject matter which is regarded as the invention.

I claim:

1. In a pallet having a platform and feet anchored to the platform to space the platform from the floor, each of said feet comprising a cup-like member oriented with the mouth opening upwardly and having an outwardly and peripherally extending flange at the upper extremity thereof, said cup-like member being insertable within a suitable hole in the platform to place the underside of the flange thereon into engagement with the upper platform surface adjacent to the hole, said cup-like member having an outwardly projecting, upwardly facing shoulder exteriorly thereof and spaced beneath the flange, said shoulder in the assembly of the cup-like member to the platform being also spaced beneath the platform, and a locking ring member having an outwardly and peripherally extending flange disposed upwardly and a shoulder engaging surface disposed downwardly beneath its flange, said locking ring member being adapted for disposal beneath the platform and exteriorly on the cup-like member to engage upon the shoulder of the cup-like member and sandwich the platform between the opposed flanges of said members.

2. In a pallet having a platform and feet anchored to the platform to space the platform from the floor, each of said feet comprising a molded plastic, frustoconically-shaped cup-like member oriented with the mouth opening upwardly and a base of reduced diameter disposed downwardly and having an outwardly and peripherally extending flange at the upper extremity thereof, said cup-like member being insertable within a suitable hole in the platform to place the underside of the flange thereon into engagement with the upper platform surface disposed adjacently to the hole, said cup-like member having an outwardly projecting, upwardly facing shoulder exteriorly thereof and spaced beneath the flange, said shoulder in the assembly of the cup-like member to the platform being also spaced beneath the platform, and a molded plastic, frustoconically-shaped locking ring member having a downwardly and inwardly tapered skirt which terminates at its lower extremity with an annular shoulder engaging surface, said locking ring further having an outwardly and peripherally extending flange at the upper extremity thereof, said locking ring being adapted for disposal beneath the platform and exteriorly of the downwardly projecting cup-like member to engage the annular surface upon the shoulder of the cup-like member and sandwich the platform between the opposed flanges of said members.

3. The structure as set forth in claim 2 wherein the opposed flanges on said members in assembled relation are disposed angularly in approaching relation relative to each other to provide for a gripping pressure on the platform and to accommodate platforms within a range of thicknesses.

4. The structure as set forth in claim 2 wherein the flange on the locking ring member extends upwardly in the range of 5° from the horizontal whereby in the assembled relation of the members the opposed flanges provide for a gripping pressure on the platform in spaced relation from the corresponding foot receiving hole in the platform.

5. The structure as set forth in claim 2 wherein the cup-like member is provided with at least a pair of vertically spaced and aligned shoulders selectively engageable by the annular shoulder engaging surface on the locking ring member to accommodate platforms of different thicknesses.

6. The structure as set forth in claim 2 wherein the inside diameter of the locking ring skirt at its lower extremity is somewhat less than the outside diameter of the shoulder on the cup-like member such that the skirt must expand when moving across the shoulder and spring back to seat the annular surface on the shoulder.

7. The structure as set forth in claim 2 wherein the cup-like members are nestable and stackable.

8. The structure as set forth in claim 2 wherein the locking ring members are nestable and stackable.

9. The structure as set forth in claim 2 wherein the assembled feet are nestable and stackable so that pallets having feet disposed in like pattern are stackable with the feet in nesting relation.

* * * * *